US006276954B1

(12) United States Patent
Arnett et al.

(10) Patent No.: US 6,276,954 B1
(45) Date of Patent: Aug. 21, 2001

(54) COMMUNICATION PLUG HAVING CONSISTENT AND SET LEVELS OF COMPLEMENTARY CROSSTALK

(75) Inventors: Jaime Ray Arnett, Fishers; Larry Edward Fortner, Indianapolis; George Willis Reichard, Carmel, all of IN (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/441,401

(22) Filed: Nov. 16, 1999

(51) Int. Cl.[7] ..... H01R 4/24
(52) U.S. Cl. ..... 439/418; 439/417
(58) Field of Search ..... 439/417, 418, 439/425, 941, 676, 403, 404; 339/99 R

(56) References Cited

U.S. PATENT DOCUMENTS 4,650,269 * 3/1987 Denkmann et al. ..... 339/99 R
5,226,835 * 7/1993 Baker, III et al. ..... 439/403
5,601,447 * 2/1997 Reed et al. ..... 439/404
5,791,943 * 8/1998 Lo et al. ..... 439/676
5,938,479 * 8/1999 Paulson et al. ..... 439/676
5,941,734 * 8/1999 Ikeda et al. ..... 439/676

* cited by examiner

*Primary Examiner*—Gary Paumen
*Assistant Examiner*—Phuong Nguyen
(74) *Attorney, Agent, or Firm*—Thomas, Kaydenm Horstemeyer & Risley, LLP

(57) ABSTRACT

A communication plug that generates crosstalk, at a predetermined level, that complements the compensating crosstalk in a legacy jack or connector. The communication plug includes an electrical connector assembly comprising a plurality of conductive blades. Each conductive blade is adapted to make electrical contact with an insulated conducting wire and with a jack spring contact. At least two of the conductive blades are configured so as to cross over each other without making electrical contact. Complementary crosstalk is generated between the conductive blades in the region where the blades engage the jack spring wires or terminals thus minimizing the propagation delay between the crosstalk signals generated in the plug and the crosstalk signals generated in the jack or connector.

20 Claims, 9 Drawing Sheets

COMMUNICATION PLUG HAVING CONSISTENT AND SET LEVELS OF COMPLEMENTARY CROSSTALK

FIELD OF THE INVENTION

The present invention relates generally to the field of modular communication plugs and, more particularly, to the generation of complementary crosstalk in a communication plug such that performance with connector jacks is optimized.

BACKGROUND OF THE INVENTION

Telecommunications and data transmission systems have evolved in recent years to accommodate the increasing demand for high speed, multi-media services. Accordingly, higher and higher frequencies are being transmitted across network infrastructure originally designed for lower frequency and volume throughput. Although present day cables and wiring, can, theoretically, handle such increased frequencies and traffic volume, the wiring paths themselves become, in effect, antennae that both radiate and receive electromagnetic radiation, thereby creating crosstalk problems. Crosstalk, i.e. the coupling of electromagnetic energy between adjacent conductors, is particularly problematic in systems incorporating multiple wire pairs. Unfortunately, the plugs and jacks that are most commonly used in interconnecting cables and hardware, such as distribution modules, generally include as many as eight wires (four wire pairs), and, in some instances, even more, that are necessarily oriented both parallel and close together, a condition that leads to excessive crosstalk, even over short distances, and which is exacerbated as the frequency of the signals or the data rate is increased.

Various techniques have been used for reducing crosstalk between pairs of wires in communication plugs and cables, such as shielding individual pairs, helically winding (twisted-pairs), or, where possible, increasing the physical separation of one pair from another. The crosstalk problem, however, cannot be solved through a simple minimization or reduction approach. While it may be desirable in future applications to eliminate virtually all crosstalk in a communication plug, legacy systems (i.e., current jacks and plugs) require a predetermined level of crosstalk in the plug for optimum performance. Legacy jacks are engineered to compensate for crosstalk in the communication plug; however, communication plugs have different crosstalk characteristics caused by variations introduced during the assembly process thereby resulting in variations in crosstalk compensation. Thus what is sought are communication plugs with uniform crosstalk characteristics, so as to consistently compliment the crosstalk engineered into the legacy jacks, and, thereby, optimizing high speed data transmission through the network.

SUMMARY OF THE INVENTION

Certain advantages and novel features of the invention will be set forth in the description that follows and will become apparent to those skilled in the art upon examination of the following or may be learned with the practice of the invention.

The present invention is generally directed to a communication plug having predetermined crosstalk characteristics. The crosstalk characteristics in communication plugs produced using the present invention are of a higher degree of uniformity than is found in current communication plugs.

The present invention comprises an assembly of crossover electrical connectors which produce a set level of crosstalk such that the compensating crosstalk in jacks is optimized to achieve higher data transmission rates.

The principles of the invention are disclosed as applied to an eight-wire communication plug typically used in high frequency data communications. Those skilled in the art will appreciate that the concepts taught herein can be applied to plugs terminating cables carrying any number of pairs of conductors or wires in which crosstalk is generated in both the plug and the jack or connector.

An eight wire communication cable used in high frequency data communication is typically comprised of four sets of helically wound twisted-pairs of insulated conducting wires surrounded by a protective jacket. To mate the communication cable with an associated communication plug a portion of the cable jacket surrounding the conducting wires is removed from one end, and the four sets of twisted-pair insulated conducting wires are partially unwound. The wires are arranged in a specific order corresponding to an industry standard, aligned with a receiving opening in the back of the communication plug and with their respective receiving slots within the communication plug, inserted into the communication plug, and secured to the communication plug. Electrical connectors are attached to the wires, through slots in the top of the communication plug. The electrical connectors are adapted to make electrical contact between associated jack springs in the jack and with the insulated conducting wires in the plug. In order for two modular communication plugs, each terminating a cable, to have uniform crosstalk characteristics the insulated conducting wires of the cable need to be dressed (untwisted, straightened, and arranged) in an essentially identical manner. Communication plugs which are identical, except for the dressing of the individual conducting wires, will often exhibit different crosstalk characteristics.

The present invention eliminates much of the dressing of the insulated conducting wires of the cable during the assembly of a communication plug. The four sets of twisted-pairs are inserted into the rear of the plug housing, through the receiving opening in the rear of the housing. The twisted-pairs are aligned with their respective receiving slots, and an electrical connector in the form of a blade is attached to each wire. The electrical connectors are adapted at one end so as to make electrical contact with an insulated conducting wire, and the other end is adapted so as to make electrical contact with a jack spring. In the present invention one or more electrical connectors of an assembly of connectors may crossover, or crossunder, one or more adjacent electrical connectors such that the location of the jack end portion of each of the electrical connectors corresponds to the industry standard. The electrical connector assembly is formed such that the electrical connectors do not make electrical contact in the crossover region.

An advantage of the present invention is that the set of twisted-pairs are dressed in substantially the same manner in every communication plug. The twisted-pairs are cut to the same length and attached to the assembly of electrical connectors. Because the conducting wires remain as twisted-pairs within the plug instead of being juxtaposed in a straight parallel manner, the crosstalk between the conducting pairs of wires within the communication plug is reduced. The electrical connectors are manufactured uniformly, and consequently the crosstalk characteristics between different sets of electrical connectors in different plugs are essentially identical. Use of the present invention eliminates the variations in the crosstalk characteristics introduced by the dressing of individual insulated conducting wires in different communication plugs, thereby producing greater uniformity in the crosstalk characteristics of different communication plugs. Another advantage is the time saving; it takes less time to align properly the four sets of twisted-pairs than it does to dress and align the individual wires.

According to another aspect of the invention, the crosstalk generated in the plug can be fixed to a desired level by modifying certain engineerable parameters such as the size and shape of the ends of electrical connector. Other engineerable parameters in the electrical connector include the length of the arm connecting, the size and shape of the insulation piercing end, and the spacing between adjacent ends, and the type of the material from which the electrical connector is made.

BRIEF DESCRIPTION OF THE DRAWINGS

Other features of the present invention will be more readily understood from the following detailed description of specific embodiments thereof when read in conjunction with the accompanying drawings.

Prior art modular communication plugs are illustrated in FIGS. 1A, 1B, and 1C.

FIG. 2A illustrates the cable and the four sets of twisted-pair conducting wires;

FIGS. 2B and 2C illustrate the dressing of the wires for prior art modular communication plugs;

FIG. 2D illustrates the dressing of the wire for the present invention;

FIG. 3A is a perspective partially exploded view of the communication plug terminating a communication cable with the electrical connector assembly not yet installed;

FIGS. 3B and 3C illustrate a cross sectional view and a view from above respectively, of the communication plug, with the electrical connector assembly installed, terminating a communication cable;

DETAILED DESCRIPTION

Figure 1A:
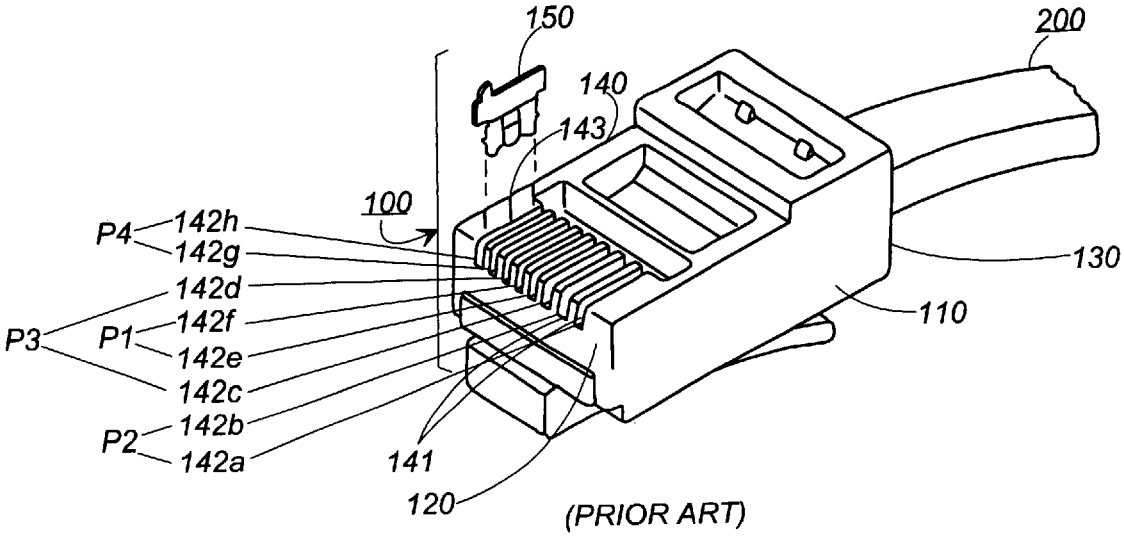
(PRIOR ART) FIG. 1A
FIG. 1A is a partially exploded perspective view a communication plug terminating a communication cable.
Figure 1B:
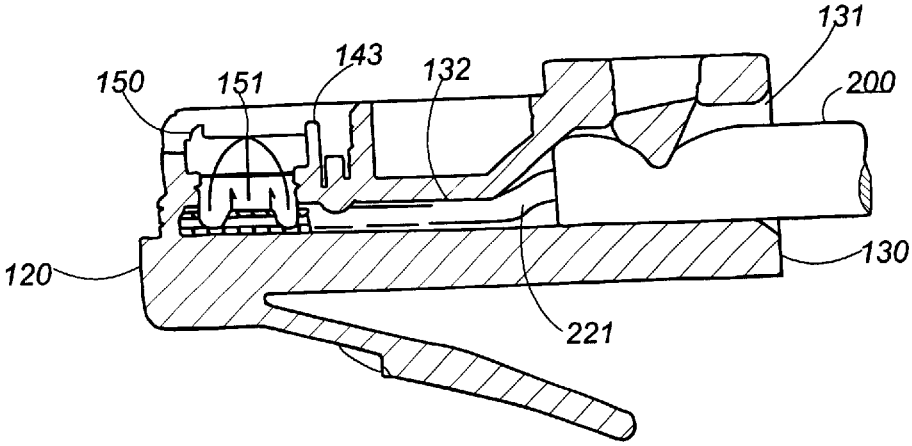
FIG. 1B (PRIOR ART)
FIG. 1B is a cross sectional view of FIG. 1A.
Figure 1C:
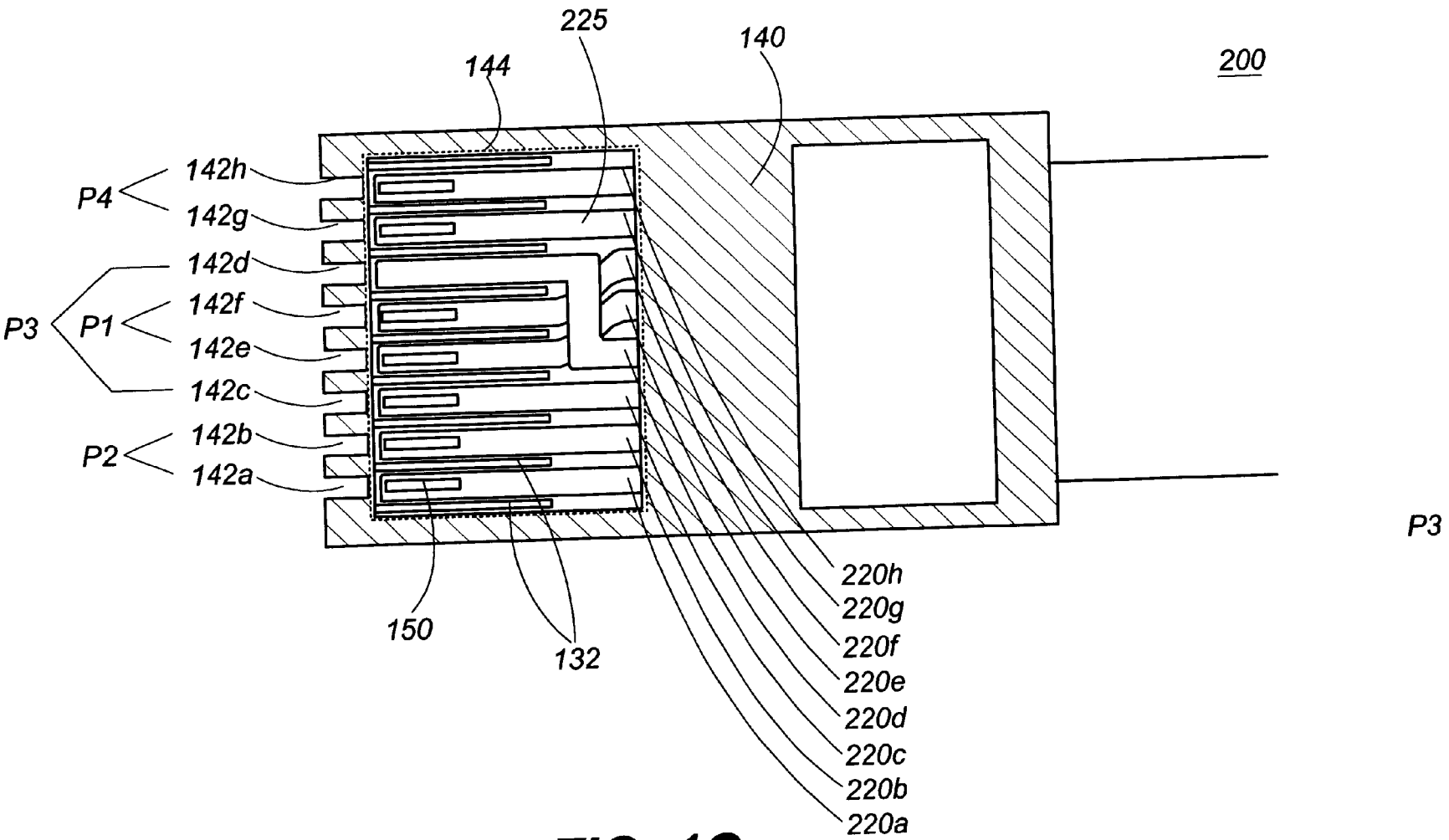
FIG. 1C (PRIOR ART)
FIG. 1C is a view from above of FIG. 1A, with a portion of the top surface cut away.

With reference to the drawings, in which like numerals indicate corresponding parts and features throughout several views, FIGS. 1A, 1B, and 1C illustrate a current modular or prior art communication plug 100. FIG. 1A is a perspective view of modular communication plug 100 terminating communication cable 200. FIG. 1B is a cross sectional view of FIG. 1A with electrical connector 150 inserted into slot 143, and FIG. 1C is a view of FIG. 1A taken from above.

As illustrated in FIGS. 1A and 1B, modular communication plug 100 comprises a housing 110 having a first end 120, a second end 130, and an upper surface 140. Extending from first end 120, a portion of upper surface 140 has a plurality of slots 141 formed therein for receiving associated jack contacts (not shown). Each jack contact receiving slot 141 has receiving slot 143 formed therein for receiving an electrical connector 150. Electrical connector slot 143 is formed to receive electrical connector 150 and to be in communication with wire receiving slot 132. Wire receiving slot 132 is formed to receive an insulated conducting wire 221, and to be in communication with cable receiving opening 131 formed in the second end 130.

In this illustration modular communication plug 100 terminates an eight wire communication cable 200 in accordance with industry standards. Terminal wiring assignments for modular plugs and jacks are specified in ANSI/EIA/TIA-568-1991 which is the Commercial Building Telecommunications Wiring Standard. The Commercial Building Telecommunications Wiring Standard associates individual wire-pairs with specific terminals for an eight-position modular communication plug; jack receiving slots 142*e* and 142*f* form terminal pair P1, slots 142*a* and 142*b* form terminal pair P2, slots 142*c* and 142*d* form terminal pair P3 and slots 142*g* and 142*h* form terminal pair P4.

Figure 2A:
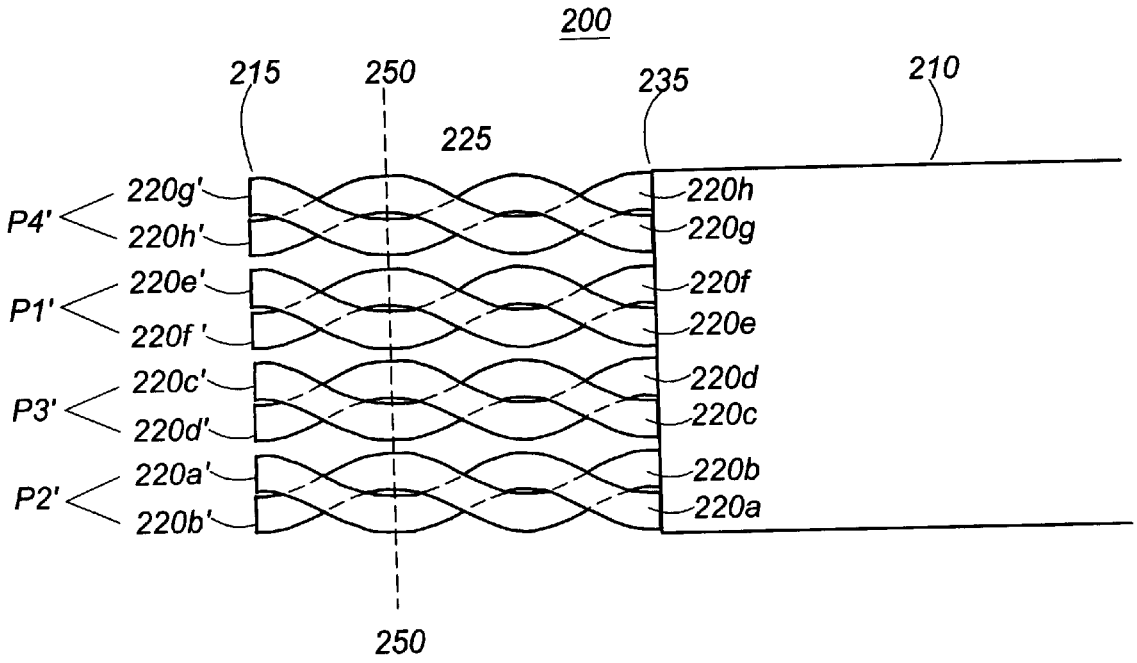
FIG. 2A (PRIOR ART)
FIGS. 2A–2D illustrate an eight-wire communication cable, used in high speed data transmission networks, in various stages of dressing so as to be mated with a communication plug.
Figure 2B:
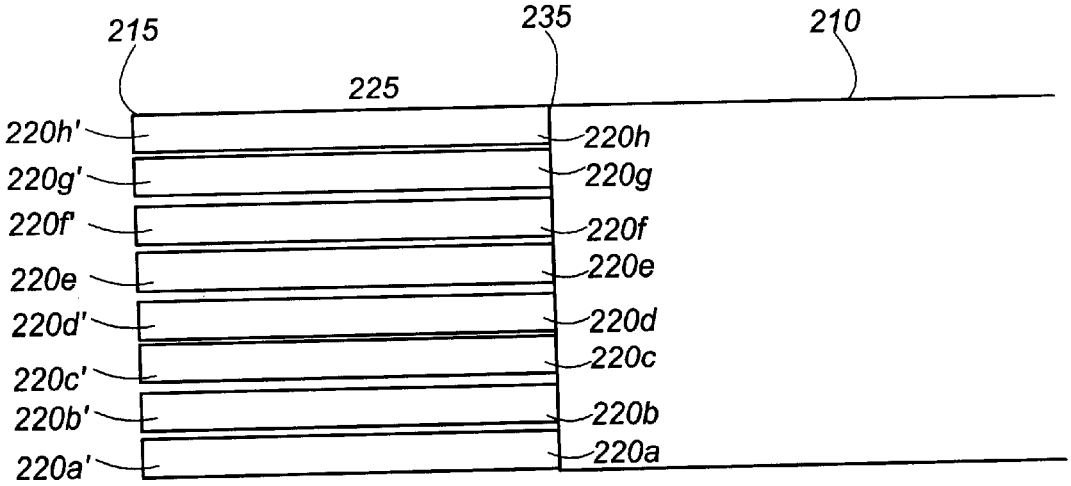
FIG. 2B (PRIOR ART)
Figure 2C:
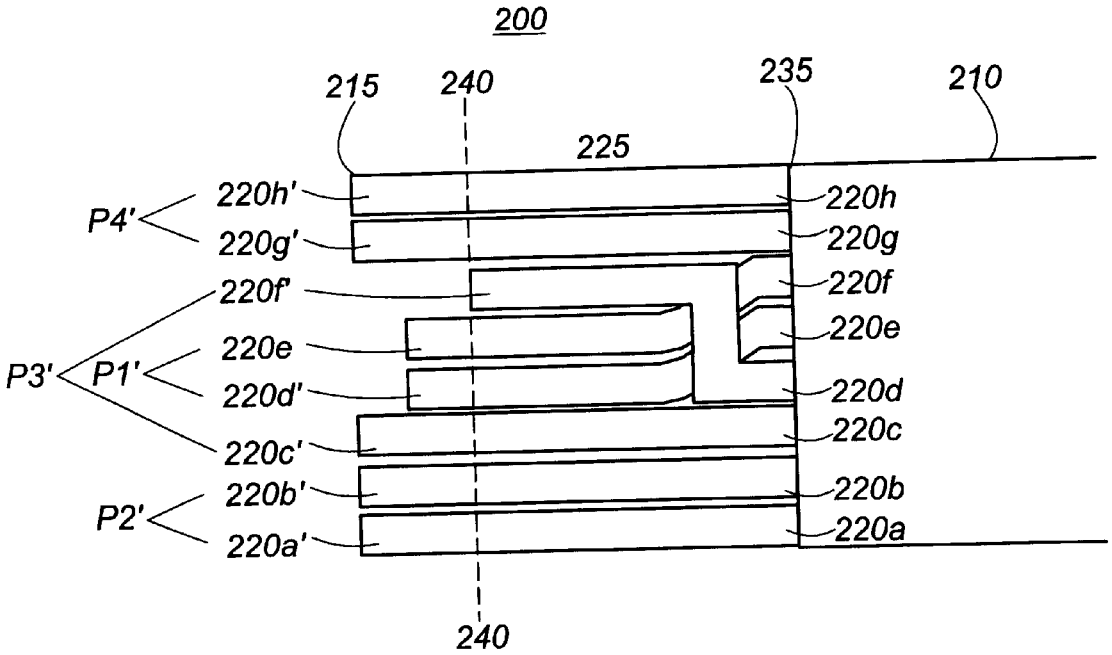
FIG. 2C (PRIOR ART)

Referring now to FIGS. 2A, 2B, and 2C, communication cable 200 is shown from above in various stages of dressing, so as to be properly received by modular communication plug 100. Communication cable 200 comprises a jacket 210, and four sets of helically twisted-pairs of wires P1'–P4', corresponding to terminal pairs P1–P4 in modular communication plug 100 shown in FIG. 1A.

In FIG. 2A, a portion of jacket 210 has been stripped from end 215 and the excess jacket has been removed at jacket end 235, thereby exposing end region 225 of insulated conducting wires 220*a*–220*h*. End region 225 of wires 220*a*–220*h* extends from jacket end 235 to wire end 215. Starting at end 215 and extending to jacket end 235 wires 220*a*–*h* are untwisted and straightened, and wire ends 220*a*'–220*h*' are arranged in sequential order, as shown in FIG. 2B. In the final stage of the dressing, as shown in FIG. 2C, wire 220*d* is positioned such that wire 220*d* traverses a portion of wires 220*e*–220*f* in region 225, and wire end 220*d*' interposes wire ends 220*f*' and 220*g*'. After the wires 220*a*–220*h* are cut along the dashed line 240, shown in FIG. 2C, communication cable 200 is dressed so as to be properly received by modular communication plug 100. Wires 220*c* and 220*d*, which form wire pair P3', straddle wires 220*e* and 220*f*, which form wire pair P1', just as terminal pair P3 straddles terminal pair P1 in modular communication plug 100, in accordance with the industry standard ANSI/EIA/TIA-568-1991.

Referring again to FIG. 1C, modular communication plug 100 is shown from above terminating communication cable 200. A portion of upper surface 140 has been cut away exposing end region 225 of wires 220*a*–220*h*; the boundary of the cut away portion is represented by dashed line 144. End region 225 of cable 200 has been inserted into modular communication plug 100 through cable receiving opening 131, and wires 220*a*–220*h* have been properly received by their respective wire receiving slots 132. Electrical connector 150 has been inserted into electrical connector receiving slot 143. Referring now to FIG. 1B, a plurality of tangs 151 protrude from the bottom region of electrical connector 150.

Tangs 151 are adapted so as to make electrical contact with insulated conducting wire 221. U.S. Pat. No. 4,650,269, hereby incorporated by reference, discloses an electrical connector used in modular communication plugs with insulation piercing tangs and adapted to make electrical contact with a jack spring.

While the above procedure for dressing wires 220*a*–220*h* of communication cable 200 is very simple it is time consuming. Other methods for dressing wires 220*a*–220*h*, such that they are in accordance with industry standards, are known; for example U.S. Pat. No. 5,888,100 teaches a more complicated and time consuming method in which wires 220*a*–220*h* are braided. As illustrated in FIGS. 2D and 3A–3C the individual wires (220*a*–220*h*) are not dressed in the present invention and consequently require less preparation time.

The level of crosstalk is largely influenced by the distance between adjacent conductors. This is because the degree of capacitive and inductive coupling between adjacent conductors, decreases roughly as the square of the distance separating the conductors, and is also strongly influenced by both the distance between and the length along which such conductors are juxtaposed. As illustrated in FIG. 1C, wires 220*a*–220*h* are essentially closely juxtaposed in a parallel manner; a configuration leading to high levels of crosstalk. Furthermore, wire pair P3' straddles wire pair P1' and is adjacent to wire pairs P2' and P4', thereby resulting in a high level of crosstalk between wire pair P3' and all of the other wire pairs. It is an aspect of the present invention to reduce the crosstalk between the wires within the modular communication plug by leaving the wires as twisted-pairs. It is another aspect of the present invention to produce modular communication plugs with a more uniform level of crosstalk. By leaving the wires as twisted-pairs the crosstalk level is not a function of juxtaposed straight parallel wires nor the position of a crossed over wire, as is the crosstalk in a current produce modular communication plug.

Industry standards, such as EIA/TIA-568, require a predetermined level of crosstalk within a coupled jack and modular communication plug. Ideally complementary crosstalk designed into the jack matches and compensates for the crosstalk introduced by the modular communication plug. However, modular communication plugs in which the insulated conductors are dressed in a non-identical manner will have non-identical cross-talk characteristics. The present invention as will be described by way of example with the FIGS. 3A–3C seeks to overcome the above mentioned problem by eliminating the untwisting of the twisted-pairs; thereby, resulting in modular communication plugs having consistent levels of crosstalk and better compatibility with coupled jacks.

Figure 3A:
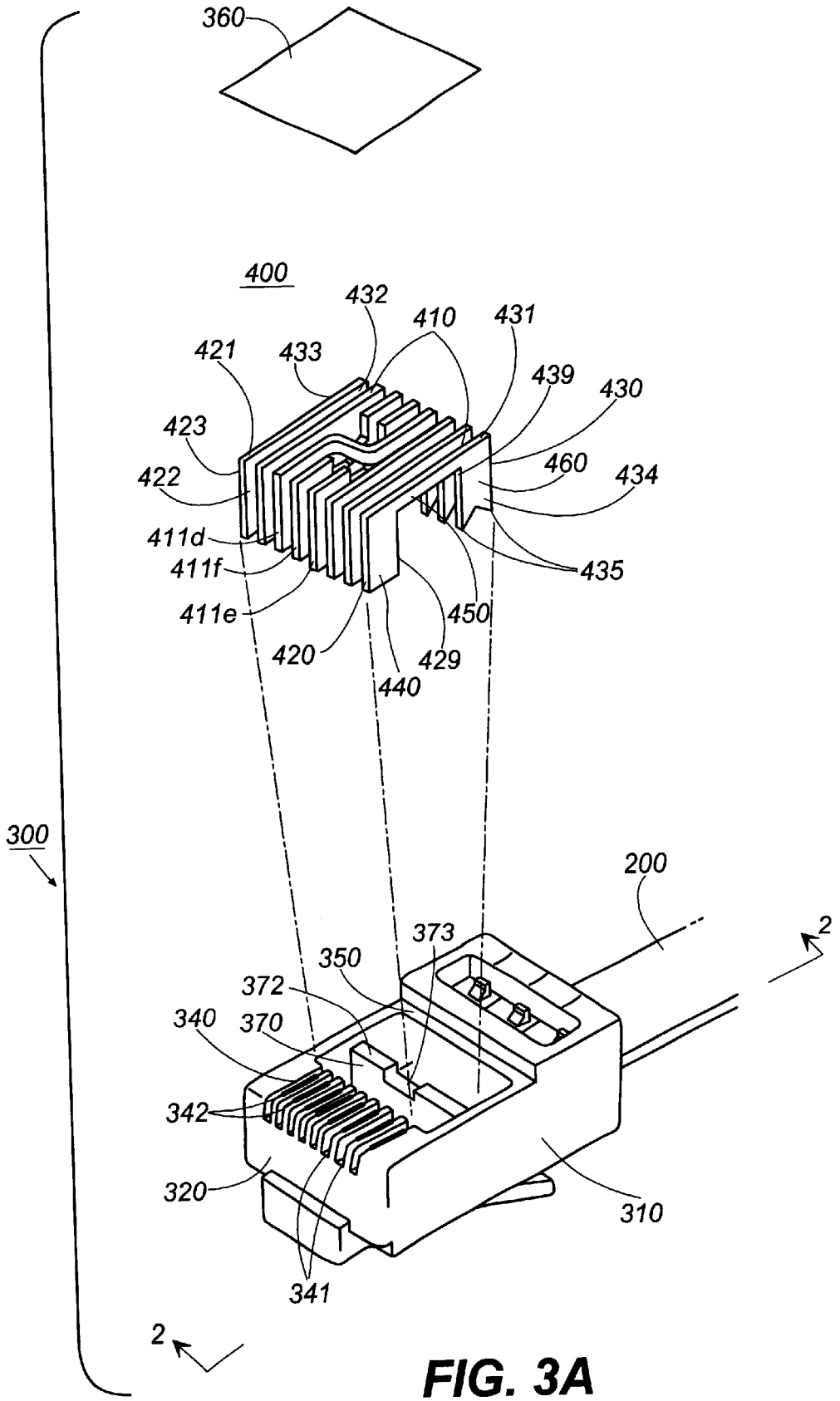
FIGS. 3A–3C illustrate the present invention, a modular communication plug with a crossover electrical connector assembly.
Figure 3B:
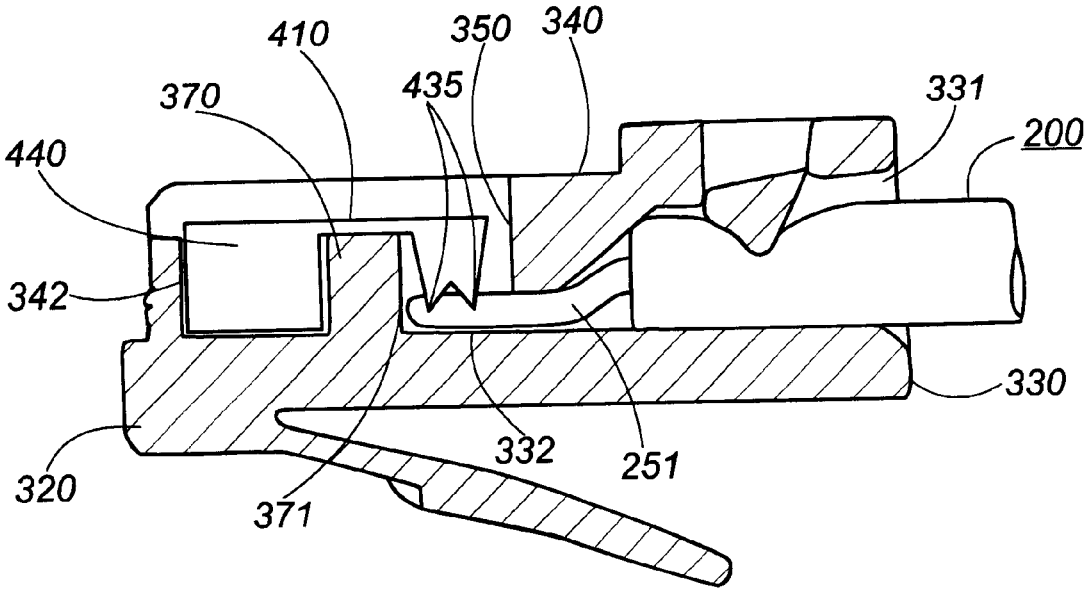
Figure 3C:
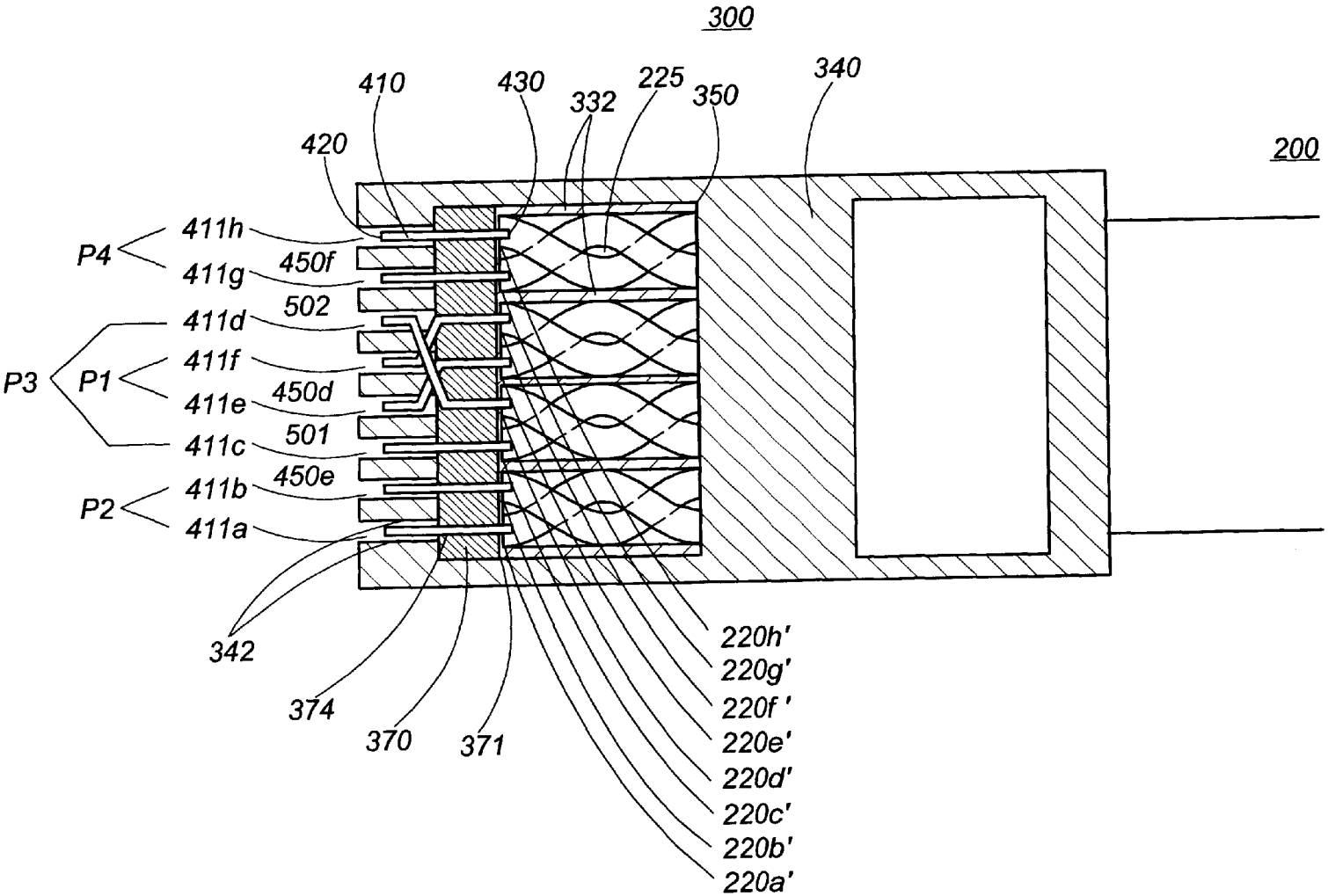

A modular communication plug 300 including an embodiment of an electrical connector assembly is illustrated in FIGS. 3A–3C. In FIG. 3A a perspective view of electrical connector 400 and a partially exploded perspective view of modular communication plug 300 terminating communication cable 200 is illustrated. In FIGS. 3B and 3C modular communication plug 300, with electrical connector assembly 400 inserted therein, is shown terminating communication cable 200 in a cross sectional view, taken along the line 2—2 in FIG. 3A, and a top view respectively. FIGS. 3A–3C will be used to illustrate the manner in which communication cable 200, modular communication plug 300, and electrical connector assembly are mated and interrelated.

As illustrated in FIGS. 3A and 3B, modular communication plug 300 comprises a housing 310 having a first end 320, a second end 330, an upper surface 340 having a opening 350 formed therein. Extending from first end 320 and adjacent thereto, a portion of upper surface 340 has a plurality of slots 341 formed therein for receiving associated jack contacts (not shown). Each jack receiving slot 341 being in communication with electrical connector receiving slot 342 formed to receive electrical connector 410. Opening 350 being in communication with twisted-pair wire receiving slot 332 formed to receive twisted-pair wires 251, and to be in communication with cable receiving opening 331 formed in the second end 330 of modular communication plug housing 410. Ridge 370 interposes jack receiving slots 342 and wire receiving slots 332, and has an upper surface 372 with a notch 373 formed therein.

Referring now to FIG. 3A, the electrical connector assembly 400 of the invention comprises a plurality of conductive blades 410 having first ends 420 and second ends 430; first ends 420 and second ends 430 being arranged in an essentially parallel manner. Conductive blades 410 are made from electrically conducting materials suitable for being formed into the desired shape: for example, copper alloy in the form of a rolled strip stock can be stamped into conductive blades 410. In this specific example conductive blade 411*d* is adapted to crossover conductive blades 411*e* and 411*f* such that there is no electrical contact between conductive blades 411*d*, 411*e*, and 411*f*.

Referring still to FIG. 3A, conductive blades 410 are comprised of three integral portion portions; jack contact portion 440, arm portion 450, and conductor piercing portion 460.

Jack contact portion 440 comprises a portion having first end 420, a second end 429, and essentially flat upper surface 421, two essentially flat planar parallel surfaces 422 and 423. Upper surface 421 is adapted to make electrical contact with jack springs (not shown). Jack portion 440 is adapted to be received by electrical connector receiving slot 342.

Referring still to FIG. 3A, arm portion 450 extends from second end 429 of jack portion 440 to the first end 439 of piercing portion 430. The arm portion 450 of conductive blades 411*e* and 411*f* is offset from the upper surface 421 of the jack contact portion 440 and offset from the upper surface 431 of the piercing portion 460. Offsetting the arm portion 450 of conductive blades 411*e* and 411*f* in this manner creates a clearance notch, whereby arm portion 450 of conductive blade 411*d* crosses over the offset arm portion 450 of conductive blades 411*e* and 411*f* without making electrical contact therewith.

Referring still to FIG. 3A, piercing portion 460 comprises a portion extending from a first end 439 to end 430, having an upper surface 431, two essentially flat planar parallel surfaces 432 and 433, and a bottom region 434. Protruding in a downward direction from bottom 434 is a plurality of tangs 435 formed to pierce the insulation surrounding an insulated conducting wire and make electrical contact with the conducting wire. As referenced above U.S. Pat. No. 4,650,269 discloses an electrical connector used in modular communication plugs with insulation piercing tangs and adapted to make electrical contact with a jack spring.

Figure 2D:
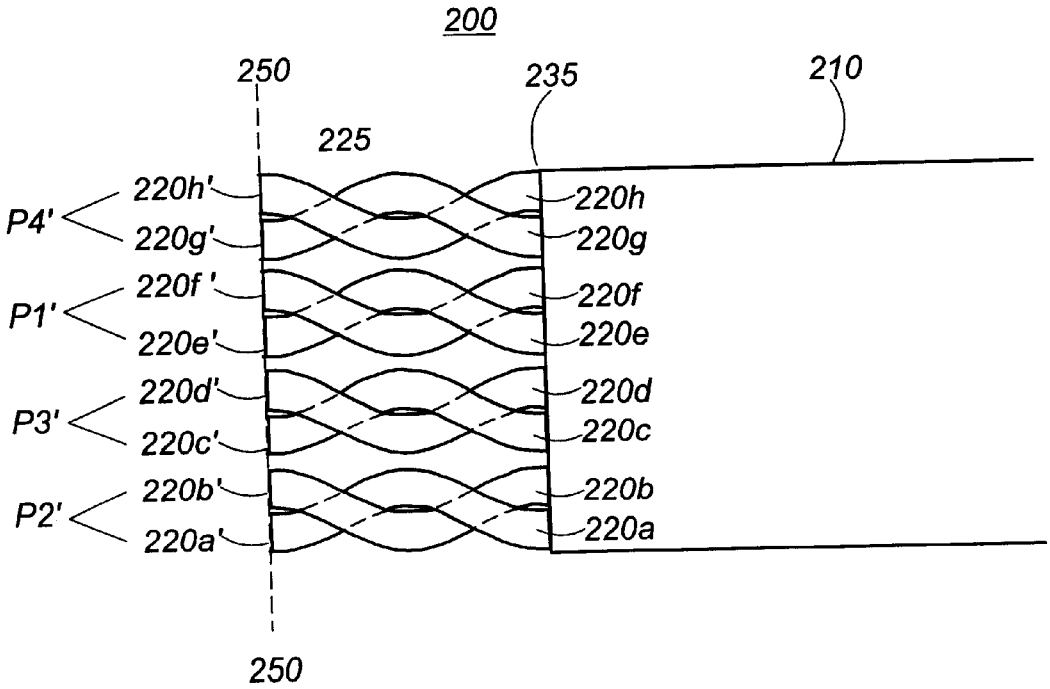

Communication cable 200 must be dressed so as to be properly mated with modular communication plug 300. As previously described and shown in FIG. 2A a portion of jacket 210 is removed from the end region 225 exposing twisted-pairs P1'–P4'. Wires 221 are cut along the dashed line 250 so that the wire ends 220*a*'–220*h*' are in sequential order as shown in FIG. 2D. In this configuration communication cable 200 is properly dressed so as to be mated with modular communication plug 300. Referring now to FIG. 3C, which shows a top view of modular communication plug 300 and communication cable 200 properly mated. To mate communication cable 200 with modular communication plug 300, end region 225 of communication cable 200 is aligned with cable receiving opening 331 formed in the rear surface 330 of modular communication plug 300 and twisted-pairs P1'–P4' are aligned with their respective receiving slots 332. Then end region 225 of communication cable 200 is inserted into cable receiving opening 331 such that wire ends 220*a*'–220*h*' abut wall 371 of ridge 370, as illustrated in FIG. 3C.

Referring now to FIG. 3A, electrical connector assembly 400 is inserted into modular communication plug 300 such that second ends 430 of electrical connector 400 are received by opening 350, and first ends 420 of electrical connector 400 are received by their respective jack portion receiving slots 342, as shown in FIG. 3B. Crossunder conductive blades 411*e* and 411*f* are inserted before crossover conductive blade 411*d* is inserted. Referring now to FIG. 3A, notch 373 of ridge 370 of modular communication plug 300 provides clearance for the offset arm portion of conductive blades 411*e* and 411*f*. In FIG. 3B, jack contact portion 440 is seated in receiving slot 342 and tangs 435 are in electrical contact with conducting wire 221. Referring now to FIG. 3C, conductive blade 411*d* crosses over conductive blades 411*e* and 411*f* such that first end 420*d* of conductive blade 411*d* interposes first end 420*f* and first end 420*g*, while the second end 430*d* interposes second ends 430*c* and 430*d*. The first end pairs P1–P4 electrically communicate with twisted-wire pairs P1'–P2' respectively and are arranged in accordance with industry standards. FIG. 3C shows another embodiment of modular communication plug 300. Ridge 370 has a plurality of slots 374 formed therein for receiving arm portion 450 of conductive blades 410. After all of the conductive blades 410 have been inserted into modular communication plug 300, electrical cover panel 360 is pressed into opening 350.

Conductive blade 411*d* crosses over conductive blades 411*e* and 411*f* in a predetermined and fixed manner; arm portion 450*d* crossing over arm portion 450*e* at region 501 and crossing over arm portion 450*f* in region 502. Arm bodies 450*d* and 450*e*, and 450*d* and 450*f* are separated by a vertical distance such that conductive blade 410*d* does not make electrical contact with conductive blade 410*e* in crossover region 501 nor with conductive blade 410*f* in crossover region 502. The fixed manner in which arm portion 450*d* crosses over arm bodies 450*e* and 450*f* provides consistent crosstalk characteristics in all electrical connector assemblies.

It is desirable to generate substantially all of the complementary crosstalk at the first end 320 of modular communication plug 300 to minimize the propagation delay between the complementary crosstalk in the plug and the compensating crosstalk in the jack. The arm portion 450 of conductor blade 410 is engineered such that the jack receiving portion 440 and the conductor piercing portion 460 are in close proximity to each other and with the first end 320. Therefore, electrical connector assembly 400 generates crosstalk in the first end 320 of modular communication plug 300, and reduces the crosstalk from the conductive wires because the wires are twisted-pairs. Industry standards, such as EIA/TIA-568, prescribe the Near End Crosstalk, also known as NEXT, in the frequency range from 1–100 MHz, and soon the standard will prescribe the NEXT performance in the frequency range of 1–250 MHz. Electrical connector assembly 400 is engineered to produce predetermined levels of crosstalk. Jack receiving portion 440 is an essentially flat parallel plate and when carrying electrical signals, the jack receiving portion of the conductive blades form capacitors causing capacitive coupling of signals between the jack receiving ends. The size and the shape of jack receiving portions 440 and of the conductive piercing portions are parameters for generating the desired level of crosstalk.

Figure 4A:
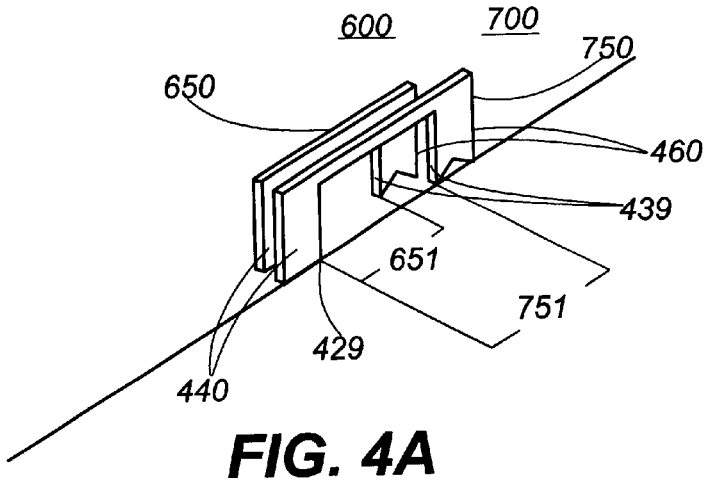
FIGS. 4A–4C are perspective views of different embodiments of the conductive blades comprising the electrical connector assembly.
Figure 4B:
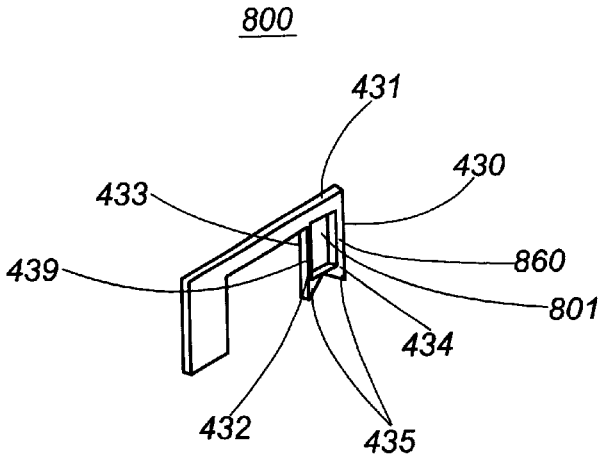
Figure 4C:
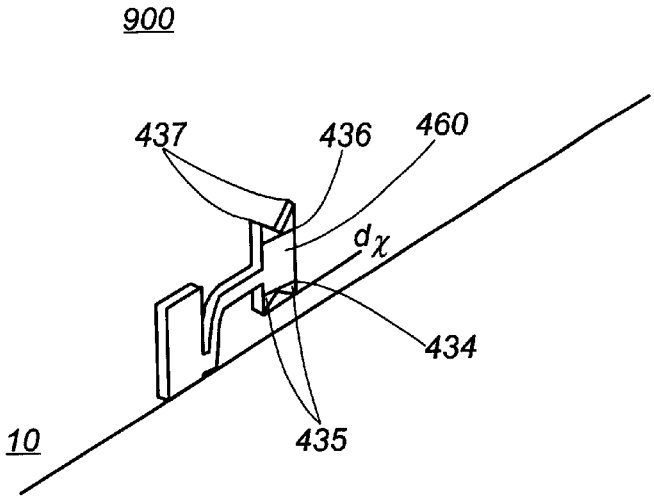

Two embodiments of conductive members of the present invention are illustrated in FIGS. 4A–4C for reducing the crosstalk at the piercing ends 430. A perspective view of electrical connectors 600 and 700 parallel to longitudinal axis 10 is shown in FIG. 4A. The jack contact bodies 440 are arranged in an essentially parallel manner, as they were in electrical connector assembly 400. The longitudinal component of arm lengths of arms 650 and 750 are measured from second end 429 of jack contact portion 440 to first end 439 of piercing portion 460 along the longitudinal axis 10. Longitudinal arm length 751 is greater than longitudinal arm 651 such that the piercing bodies 460 extending from first end 439 to second end 420 are no longer adjacent and parallel; thereby reducing the capacitive crosstalk.

In addition to staggering the piercing bodies the capacitive crosstalk can be reduced between adjacent piercing bodies by reducing the size of the piercing bodies. A perspective view of electrical connector member 800 is shown in FIG. 4B. Piercing portion 860 of electrical connector member 800 comprises a portion extending from first end 439 to end 430, having an upper surface 431, and bottom 434 region, and two essentially flat planar parallel surfaces 432 and 433 with a opening 801 formed therethrough. Opening 801 reduces the surface area piercing portion 860, thereby reducing the capacitive coupling between adjacent electrical connector members.

In FIG. 4C piercing portion 460 of electrical connector member 900 has tangs 435 and 437 protruding from bottom region 434 and top region 436 respectively. In this embodiment piercing portion 460 is displaced from longitudinal axis 10 by a transverse amount $d_x$. Rotating electrical connector member 900 by 180° about longitudinal axis 10 will result in the transverse displacement of piercing portion 460 to be $-d_x$, and in tangs 437 to be orientated in a generally downward direction. Electrical connector 900 can be used in communication plugs requiring either a positive or negative transverse displacement of piercing portion 460 relative to longitudinal axis 10.

Figure 5A:
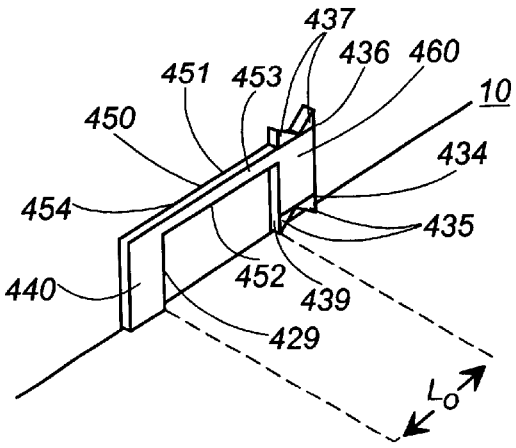
FIGS. 5A–5C are perspective views three electrical connectors cut from the same stamp.

Designing the electrical connectors to have tangs protruding form the top region and the bottom region enables crossover, crossunder, and straight electrical connectors to be produced from the same stamp. FIGS. 5A–5E illustrate, from a perspective view and a view from above, all of the above mentioned electrical connectors. Referring to FIG. 5A, straight electrical connector 1000, having a plurality of tangs 435 and 437 protruding from lower region 434 and upper region 436 respectively, is illustrated after being formed from a stamp. Arm 450 comprising a generally flat planar upper surface 451, a generally flat lower surface 452, and two generally flat planar side surfaces 453 and 452, extending in a generally straight manner along longitudinal axis 10 from second end 429 of contact portion 440 to first end 439 of piercing portion 460. The length of arm 450, as measured along longitudinal axis 10 is approximately $L_1$.

Figure 5B:
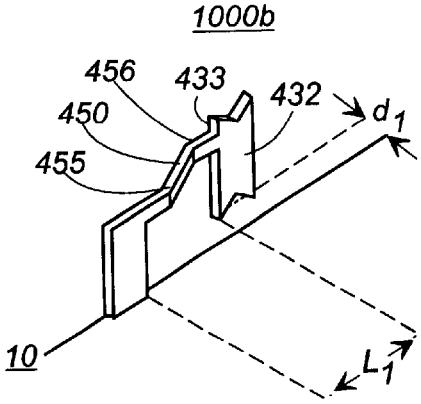
Figure 5C:
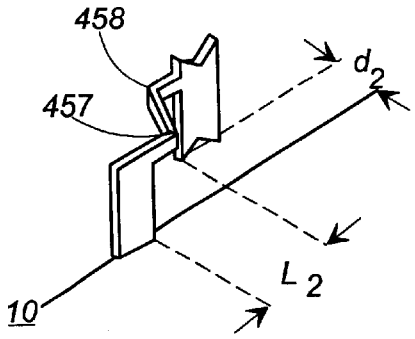
Figure 5D:
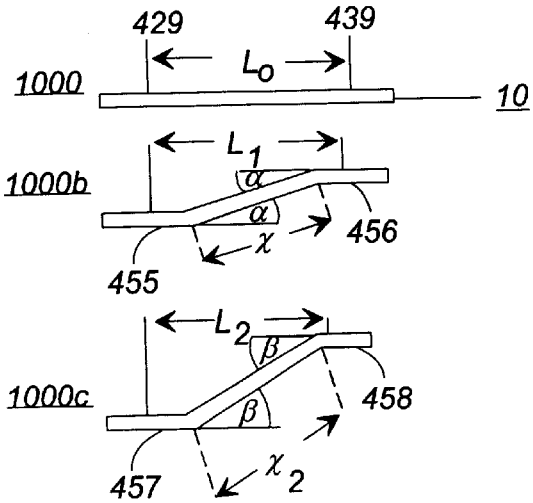
FIGS. 5D–5E are views from above of the electrical connectors illustrated in FIGS. 5A–5C.

Electrical connector 1000 can be formed into a crossing member, either over or under, by appropriately bending arm 450. In FIG. 5B electrical connector 1000(*b*) is illustrated with arm 450 having a first bend 455 and a second bend 456, separated by a distance $x_1$, each bend essentially flat and planar with respect to upper surface 451. As illustrated in FIG. 5D the angle defining first bend 455 is an acute angle $\alpha$ and the angle defining second bend 456 is an acute angle approximately $-\alpha$. Second bend 456 compensates for first bend 455 such that sides 432 and 433 of piercing portion 460 are essentially parallel to longitudinal axis 10, and piercing portion 460 is transversely displaced from longitudinal axis 10 by an amount $d_1$.

The transverse displacement $d_1$ of piercing portion 460 is a function the angle defining the first and second bends and of the distance separating the bends. In FIG. 5C electrical connector 1000*c* is illustrated wherein arm 450 having a first bend 457 and a second bend 458 separated by a distance $x_2$, and each bend is formed such that surfaces 451 and 452 remain essentially flat and planar. Referring again to FIG. 5D, first bend 457 is an acute angle $\beta$ and second bend 458 is an acute angle approximately $-\beta$. First and second bends 457 and 458 are formed such that piercing portion 460 is essentially parallel to longitudinal axis 10 and transversely displaced from longitudinal axis 10 by an amount $d_2$. By rotating electrical connector 1000*c* about longitudinal axis 10 by 180 degrees tangs 437 protrude in a generally downward direction, and piercing portion 460 is now translated from longitudinal axis 10 by an amount $-d_2$. In this illustration the displacement $d_2$ is twice the displacement $d_1$.

Figure 5E:
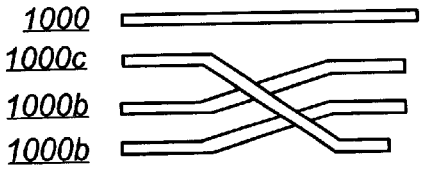

When electrical connector 1000*c* is orientated as previously described and properly aligned with electrical connector 1000*b* the connectors form a crossing pair, electrical connector 1000*b* crosses over and electrical connector 1000*c* crosses under. FIG. 5E illustrates electrical connector crossing under two electrical connectors of type 1000*b*. If electrical connector 1000*b* had been rotated about longitudinal axis 10 instead of electrical connector 1000*c*, then role of the electrical connectors within the crossing pair would be reversed. Thus, all of the electrical connectors can be formed from a stamped electrical connector having tangs protruding from the top region and the bottom region of the piercing portion.

The principles of the present invention have been illustrated herein as embodied in a communication plug for a multi-wire cable. From the foregoing, it can readily be seen that the communication plug can be engineered during the design process to generate complementary crosstalk to match the characteristics of the jack or connector to which the plug will be mated. The complementary crosstalk is generated at the nose or front of the plug where the members comprising the electrical connector assembly engage the jack springs in the jack or connector thus minimizing any signal propagation delay. Most importantly, however, the enables the production of modular communication plugs with consistent levels of crosstalk by engaging twisted-pairs of insulated conducting wires in a uniform manner. Several engineerable parameters are identified that can be adjusted during the design and manufacturing phases of the plug to fix the complementary crosstalk level.

In concluding the detailed description, it should be noted that it will be obvious to those skilled in the art that many variations and modifications can be made to the preferred embodiment without substantially departing from the principles of the present invention; for example: a dielectric can be inserted into regions 501 and 502 to prevent electrical contact between conductive blades 411*d*, 411*e* and 411*f*; conductive blades 410 can be heated and inserted into modular communication plug 300 such that arm portion 450 melts a portion of ridge 470 thereby insulating the arm portion with the dielectric forming ridge 370. In another embodiment, jack receiving slot 341 would not have conductive blade receiving slot 342 formed therein. Conductive blade 410 would be heated, such that when heated conductive blade 410 is inserted into modular communication plug 300, a portion of heated conductive blade 410 would melt a portion of the dielectric material in the bottom of jack receiving slot 341. Upon cooling, a portion of conductive blade 410 would be embedded in the solidified dielectric material and fixedly held therein. All such variations and modifications are intended to be included herein within the scope of the present invention, as set forth in the following claims.

We claim:

1. A communication plug for terminating a cable having a plurality of insulated wires therein adapted to be received by a jack, said plug comprising:

a housing for inserting into a jack having two side walls, first and second ends and an upper surface extending between said ends;

said second end having an opening therein for receiving the cable;

said upper surface having an array of a plurality of slots therein adjacent said first end and having a first opening therein between said slots and said second end;

a connector assembly comprising a plurality of conductive blades each having a first end insertable into one of said slots and a second end insertable into said first opening of said upper surface for making electrical contact with a wire of the cable, wherein each second end of the plurality of conductive blades is inserted into said first opening of said upper surface;

at least two of said blades crossing each other in a crossover region between said first and said second ends of said blades and, wherein said second end of each of said conductive blades has a lower surface, and said lower surface has a plurality of tangs extending generally downward adapted to make electrical contact with a wire of the cable.

2. A communication plug for terminating a cable having a plurality of insulated wires therein, said plug comprising:

a housing having two side walls, first and second ends and an upper surface extending between said ends;

said second end having an opening therein for receiving the cable;

said upper surface having an array of a plurality of slots therein adjacent said first end and having a first opening therein between said slots and said second end;

a connector assembly comprising a plurality of conductive blades each having a first end insertable into one of said slots and a second end insertable into said first opening of said surface for making electrical contact with a wire of the cable, and wherein each of said conductive blades comprises a first substantially planar end and a second substantially planar end spaced from said first end and conductively connected thereto by an arm portion;

at least two of said blades crossing each other in a crossover region between said first and said second ends of said blades, and wherein each of the planar ends of at least one of said blades has an upper surface, and said arm portion is offset from said upper surfaces to form a clearance notch for an arm portion crossing over the arm portion of said at least one blade;

a cavity having a ridge formed therein, said cavity being in communication with said first opening of said upper surface;

said ridge extending between said two side walls, abutting said plurality of slots of said upper surface.

3. The communication plug of claim 2, wherein said ridge has a notch formed therein for providing clearance of said offset arm portion of said at least one blade.

4. The communication plug of claim 2, wherein said ridge has a plurality of slots formed therein, each of said plurality of slots of said ridge formed to receive one arm portion of said plurality of blades.

5. A communication plug for terminating a cable having a plurality of insulated wires therein adapted to be received by a jack, said plug for terminating a cable having a plurality of insulated wires therein, said plug comprising:

a housing for inserting into a jack and having two side walls, opposed first and second ends, and an upper surface extending between said opposed ends;

said second end having an opening formed therein for receiving a cable;

said upper surface having a plurality of slots formed therein adjacent said first end and having a first opening formed therein in communication with said slots, said first opening being located between said slots and said second end, and wherein said plurality of slots and said first opening cooperate to receive a connector assembly;

a cavity having a ridge formed therein, said cavity being in communication with said first opening of said upper surface;

said ridge extending between said two side walls, abutting said plurality of slots of said upper surface;

a connector assembly comprising a plurality of conductive blades each having a first end insertable into one of said slots and a second end insertable into said first opening of said upper surface for making electrical contact with a wire of a cable; and at least two of said blades crossing each other in a cross over region between said first and second ends of said blades.

6. The communication plug of claim 5, wherein said ridge has a notched formed therein for providing clearance of said offset arm portion of said at least one blade.

7. The communication plug of claim 5, wherein said ridge has a plurality of slots formed therein, each of said plurality of slots of said ridge formed to receive one arm portion of said plurality of blades.

8. A communication plug for terminating a cable having a plurality of insulated wires therein adapted to be received by a jack, said plug comprising:

a housing for inserting into a jack having two side walls, first and second ends and an tipper surface extending between said ends;

said second end having an opening therein for receiving the cable;

said upper surface having an array of a plurality of slots therein adjacent said first end and having a first opening formed therein abutting said slots and extending toward said second end;

a connector assembly comprising a plurality of conductive blades each having a first end insertable into one of said slots and a second end insertable into said first opening of said upper surface for making electrical contact with a wire of the cable, wherein each second end of the plurality of conductive blades is inserted into said first opening of said upper surface;

at least two of said blades crossing each other in a crossover region between said first and said second ends of said blades.

9. The communication plug of claim 8, wherein said second end of each of said conductive blades has an upper surface, and wherein said upper surface has a plurality of tangs adapted to make electrical contact with a wire of the cable.

10. The communication plug of claim 8, wherein said second end of each of said conductive blades has an upper surface and a lower surface, and said upper surface and said lower surface each has a plurality of tangs adapted to make electrical contact with a wire of the cable.

11. The communication plug of claim 8, said communication plug further comprising:

a panel for covering said first opening of said upper surface.

12. A communication plug as claimed in claim 8 wherein each of said conductive blades comprises a first substantially planar end and a second substantially planar end spaced from said first end and conductively connected thereto by an arm portion.

13. A communication plug as claimed in claim 12 wherein each of the planar ends of at least one of said blades has an upper surface and said arm portion is offset from said upper surfaces to form a clearance notch for an arm portion crossing over the arm portion of said at least one blade.

14. The communication plug of claim 13, wherein said second end of each of said conductive blades has two essentially flat planar sides, and said essentially flat planar sides has an opening formed therethrough.

15. A communication plug for terminating a cable having a plurality of insulated wires therein adapted to be received by a jack, said plug for terminating a cable having a plurality of insulated wires therein, said plug comprising:

a housing for inserting into a jack and having two side walls, opposed first and second ends, and an upper surface extending between said opposed ends;

said second end having an opening formed therein for receiving a cable;

said upper surface having a plurality of slots formed therein adjacent said first end and having a first opening formed therein abutting said slots and in communication with said slots, and wherein said plurality of slots and said first opening cooperate to receive a connector assembly;

a connector assembly comprising a plurality of conductive blades each having a first end insertable into one of said slots and a second end insertable into said first opening of said upper surface for making electrical contact with a wire of a cable; and at least two of said blades crossing each other in a cross over region between said first and second ends of said blades.

16. A communication plug as claimed on claim 15, wherein said first opening of said upper surface is in communication with said cable receiving opening.

17. A communication plug as claimed in claim 16, wherein each of said conductive blades comprises a first substantially planar end and a second substantially planar end spaced from said first end and conductively connected thereto by an arm portion.

18. A communication plug as claimed in claim 17, wherein each of the planar ends of at least one of said blades has an upper surface and said arm portion is offset from said upper surfaces to form a clearance notch for an arm portion crossing over the arm portion of said at least one blade.

19. The communication plug of claim 18, wherein said second end of each of said conductive blades has two essentially flat planar sides, and said essentially flat planar sides have an opening formed therethrough.

20. The communication plug of claim 18, wherein said first ends of said conductive blades and second ends of said conductive blades are substantially aligned.

* * * * *